US006395945B1

(12) United States Patent
Randolph

(10) Patent No.: US 6,395,945 B1
(45) Date of Patent: May 28, 2002

(54) INTEGRATED HYDROISOMERIZATION ALKYLATION PROCESS

(75) Inventor: Bruce B. Randolph, Bartlesville, OK (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/539,948

(22) Filed: Mar. 31, 2000

(51) Int. Cl.[7] ..... C07C 2/00; C07C 5/23; C07C 2/56

(52) U.S. Cl. ..... 585/332; 585/664; 585/670; 585/709; 585/717

(58) Field of Search ..... 585/332, 664, 585/670, 704, 717

(56) References Cited

U.S. PATENT DOCUMENTS 5,237,115 A 8/1993 Makovec et al. ..... 585/314
5,254,790 A 10/1993 Thomas et al. ..... 585/717
5,382,744 A 1/1995 Abbott et al. ..... 585/709
5,684,220 A 11/1997 Johnson et al. ..... 585/332
5,900,522 A 5/1999 Hommeltoft ..... 585/708
5,969,205 A * 10/1999 Stuwe et al. ..... 585/664

* cited by examiner

*Primary Examiner*—Thuan D. Dang
(74) *Attorney, Agent, or Firm*—Jeffrey R. Anderson

(57) ABSTRACT

A novel integrated olefin processing scheme is provided where olefins and paraffins are processed to produce high octane gasoline blending components. The integrated process involves the processing of olefins by hydroisomerization to produce a hydroisomerate stream which is subsequently alkylated in an alkylation process with branched chain paraffin hydrocarbons to produce an alkylate product. The alkylate product can further be separated into various fractions, including propane, n-butane, i-butane and a $C_5$+ alkylate stream. The $C_5$+ alkylate stream can be separated into an i-pentane stream and a deisopentanized $C_5$+ alkylate stream.

12 Claims, 1 Drawing Sheet

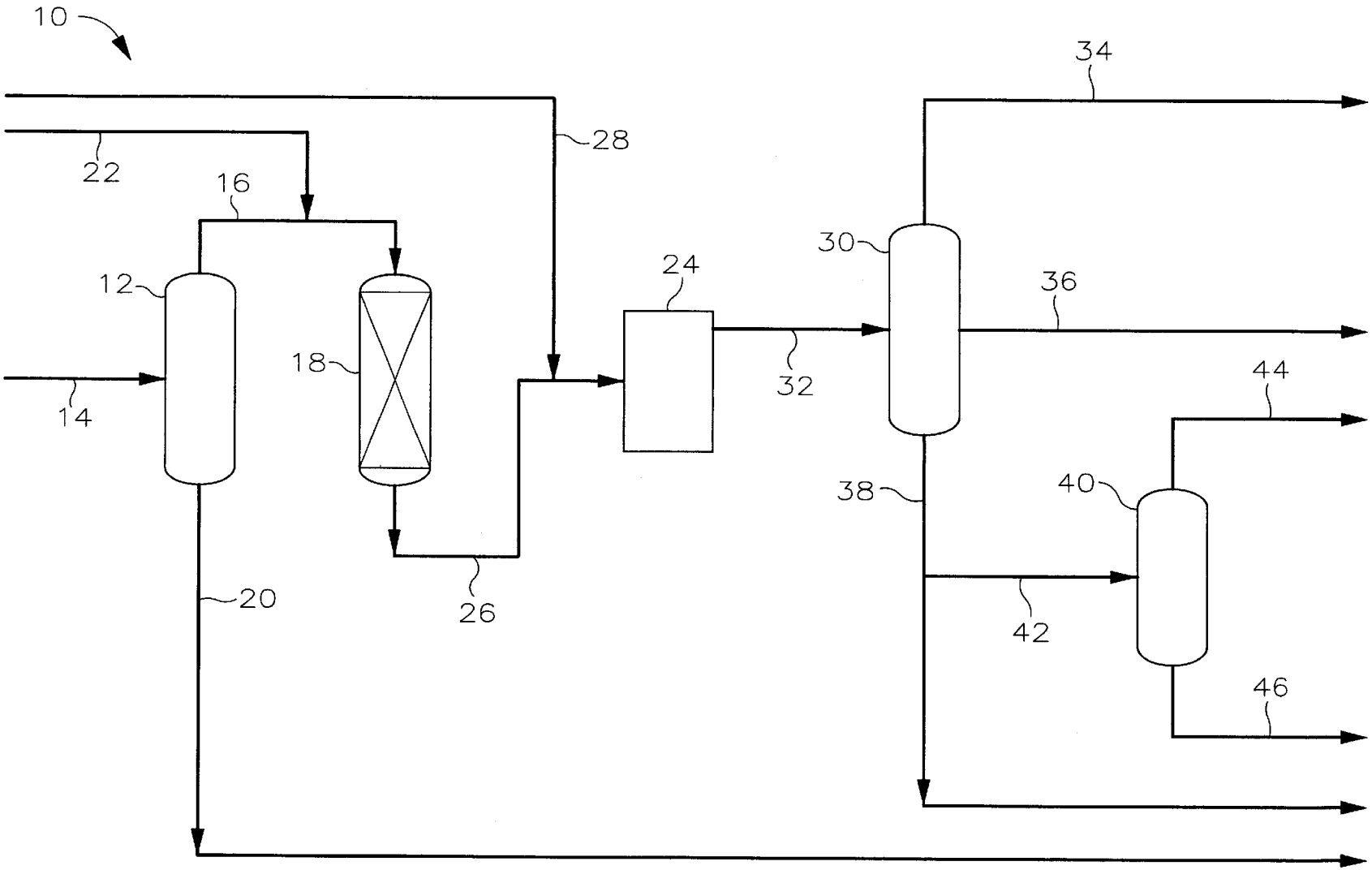
10
12
14
16
18
20
22
24
26
28
30
32
34
36
38
40
42
44
46

INTEGRATED HYDROISOMERIZATION ALKYLATION PROCESS

BACKGROUND OF THE INVENTION

This invention relates to a process for producing gasoline blending components. More specifically, this invention relates to the processing of paraffinic and olefinic hydrocarbons in an integrated system to produce gasoline blending components.

Recent governmental regulations in response to the 1990 Clean Air Act have resulted in the requirement that motor gasoline be reformulated to include greater concentration levels of oxygenates and lower concentrations of aromatic and olefinic hydrocarbons. Other such regulations require reductions in permissible gasoline vapor pressure.

However, the removal of at least some of the aromatic and olefinic hydrocarbons from the gasoline pool, due to restrictions on aromatic and olefinic hydrocarbon concentrations, and the removal of normal butane from the gasoline pool, due to restrictions on permissible vapor pressure, will result in reducing the available gasoline pool octane.

In addition, $C_5$ olefins contained in some gasoline blending stocks have good octane characteristics but are also very volatile and contribute greatly to ozone and smog formation in the lower atmosphere. For this reason, there is an incentive to remove $C_5$ olefins from gasoline, however, the octane lost from such removal has to be replaced.

Therefore, development of a process to convert $C_5$ olefins to a high octane, low vapor pressure gasoline blending stock would be a significant contribution to the art and to the economy.

SUMMARY OF THE INVENTION

It is an object of the present invention to provide an integrated process for upgrading paraffins and olefins to produce valuable gasoline blending components.

It is a further object of the present invention to provide an integrated process for upgrading paraffins and olefins which reduces the operating costs associated with the produced gasoline blending components.

It is yet a further object of the present invention to provide an integrated process for upgrading a gasoline blending stock by reducing the $C_5$ olefin concentration while maintaining its octane rating.

In accordance with the present invention, a process for upgrading paraffins and olefins has been discovered comprising the steps of:

a) hydroisomerizing said hydrocarbon feedstock in a hydroisomerization zone so as to produce a hydroisomerate stream; and b) alkylating at least a portion of said hydroisomerate stream by a branched chain paraffin hydrocarbon in an alkylation unit to produce an alkylate stream.

Other objects and advantages will become apparent from the detailed description and the appended claims.

BRIEF DESCRIPTION OF THE DRAWING

The FIGURE is a schematic flow diagram presenting an embodiment of the present invention.

DETAILED DESCRIPTION OF THE INVENTION

The process of the present invention comprises, consists of, or consists essentially of hydroisomerizing a hydrocarbon feedstock comprising, consisting of, or consisting essentially of at least one $C_5$ olefin so as to produce a hydroisomerate stream; and, alkylating at least a portion of the hydroisomerate stream by a branched chain paraffin hydrocarbon to produce an alkylate stream.

The $C_5$ olefin of the hydrocarbon feedstock can comprise, consist of, or consist essentially of an olefin selected from the group consisting of 2-pentene, 2-methyl-butene-2, 1-pentene, 3-methyl-butene-1, 2-methyl-butene-1, isoprene, piperylene, cyclopentene, and combinations of any two or more thereof.

The hydrocarbon feedstock can be any gasoline range hydrocarbon stream which contains at least one $C_5$ olefin. Most typically, the hydrocarbon feedstock is a $C_5$ fraction separated from a gasoline range hydrocarbon stream comprising hydrocarbons having at least three carbon atoms per molecule and, preferably at least 5 carbon atoms per molecule, with the other separated fraction being a $C_6$+ gasoline blending stock. The gasoline range hydrocarbon stream can include gasolines obtained from a catalytic cracking process, a thermal cracking process, naphthas, gas oils, refomates, straight-run gasoline, and the like. The most suitable source for the gasoline range hydrocarbon stream is a catalytic cracking process.

The hydroisomerization of the hydrocarbon feedstock includes: 1) hydrogenation of isoprene and piperylene to mono-olefins; 2) conversion of a portion of the cyclopentene to cyclopentane; and 3) isomerization of a portion of the 1-pentene to 2-pentene.

The hydroisomerization of the hydrocarbon feedstock is performed in a hydroisomerization zone which includes a hydroisomerization catalyst, the presence of hydrogen, and which is operated under hydroisomerization conditions sufficient to hydrogenate diolefins to mono-olefins and to isomerize mono-olefins. Preferably, the hydroisomerization conditions include a temperature in the range of from about 0° F. to about 500° F., more preferably from about 75° F. to about 400° F., and most preferably from 100° F. to 200° F.; a pressure in the range of from about 100 psig to about 1500 psig, more preferably from about 150 psig to about 1000 psig, and most preferably from 200 psig to 600 psig; and a liquid hourly space velocity (LHSV) in the range of from about 0.01 $hr.^{-1}$ to about 100 $hr.^{-1}$, more preferably from 1 $hr.^{-1}$ to about 50 $hr.^{-1}$, and most preferably from 5 $hr.^{-1}$ to 15 $hr.^{-1}$.

The term LHSV, as used herein, shall mean the numerical ratio of the rate at which a hydrocarbon feed is charged to the hydroisomerization zone in cubic centimeters/per hour divided by the number of cubic centimeters of catalyst contained in the hydroisomerization zone.

The hydroisomerization catalyst is preferably a dual function catalyst capable of hydrogenating diolefins to mono-olefins and isomerizing mono-olefins. The more preferred hydroisomerization catalyst comprises palladium and alumina.

Hydrogen is present in the hydroisomerization zone at a level such that the hydrogen to diolefin mole ratio is in the range of from about 0.5 to about 50, more preferably from about 1 to about 20, and most preferably from 3 to 6.

The hydroisomerate stream produced contains reduced concentrations of isoprene, piperylene and cyclopentene as compared to the hydrocarbon feedstock. The presence of isoprene, piperylene and cyclopentene in a feed to an alkylation process can result in increased acid soluble oil (ASO) production. ASO is an undesirable alkylation by-product comprising conjunct polymers which are highly olefinic oils.

Also, due to the isomerization of 1-pentene to 2-pentene, the mole ratio of 2-pentene to 1-pentene in the hydroisomerate stream is higher than the mole ratio of 2-pentene to 1-pentene in the hydrocarbon feedstock.

The alkylation of the hydroisomerate stream is performed in an alkylation unit and under alkylation conditions suitable for alkylating the hydroisomerate stream by a branched chain paraffin hydrocarbon to produce an alkylate stream.

Optionally, a light olefin stream comprising, consisting of, or consisting essentially of an olefin selected from the group consisting of i-propylene, i-butene, 2-butenes, 1-butenes, and combinations of any two or more thereof, can be combined with and become a part of the hydroisomerate stream prior to alkylation of the hydroisomerate stream.

Suitable alkylation units include, but are not limited to, those employing hydrofluoric (HF) acid, or sulfuric acid, or a solid acid as an alkylation catalyst. The most suitable alkylation unit is an HF alkylation unit wherein isoparaffins and olefins are alkylated by contact with an alkylation catalyst comprising hydrofluoric acid, and optionally, a volatility reducing additive, in a riser (upwardly flowing) reactor with a subsequent routing of the alkylation reaction mixture to a settler for separation into a hydrocarbon phase comprising an alkylate product and an alkylation catalyst mixture phase comprising the alkylation catalyst and an ASO reaction by-product. At least a portion of the hydrocarbon phase is withdrawn from the settler to form an alkylate stream.

The branched chain paraffin hydrocarbon can comprise, consist of, or consist essentially of a hydrocarbon selected from the group consisting of i-butane, i-pentane, and combinations thereof.

The alkylate stream comprises, consists of, or consists essentially of alkylated hydrocarbons having from 5 to 20 carbon atoms per molecule, unreacted branched chain paraffin hydrocarbons, and i-pentane.

In one embodiment, the alkylate stream is separated into a $C_5$+ alkylate stream comprising, consisting of, or consisting essentially of hydrocarbons having greater than 4 carbon atoms per molecule, preferably from 5 to 20 carbon atoms per molecule, and most preferably from 5 to 10 carbon atoms per molecule. The $C_5$+ alkylate stream, which will have enhanced octane as compared to the hydroisomerate stream, can be utilized as a gasoline blending stock.

The $C_5$+ alkylate stream can be separated into an i-pentane stream and a deisopentanized $C_5$+ alkylate stream. The i-pentane stream, high in octane, can be added to the $C_6$+ gasoline blending stock, or otherwise utilized as a gasoline blending stock, to replace the octane lost from the removal of the high octane $C_5$ olefins from the gasoline range hydrocarbon stream, as described above. This results in a gasoline blending stock that has good octane quality and a lower olefin content as compared to the unprocessed gasoline range hydrocarbon stream described above.

The deisopentanized $C_5$+ alkylate stream can also be used as a separate gasoline blending stock having good octane quality.

In another embodiment, in addition to separating the alkylate stream into a $C_5$+ alkylate stream, the alkylate stream can also be separated into a n-butane stream and an i-butane stream. The i-butane stream can be recycled to the alkylation unit for use as the branched chain paraffin hydrocarbon, or used as a gasoline blending component. The n-butane stream can also be used as a gasoline blending component, or isolated for use as liquefied petroleum gas (LPG).

In yet another embodiment, in addition to blending the i-pentane stream into the $C_6$+ gasoline blending stock, the i-pentane stream can also be sent downstream for further processing which can include disproportionation in a disproportionation zone operated under conditions suitable to convert i-pentane to i-butane and i-hexane. Typical, but certainly not the only, methods for disproportionating i-pentane are disclosed in U.S. Pat. Nos. 5,900,522; 5,414,184; and 5,489,727, the contents of which are incorporated herein by reference.

Now referring to the FIG., there is depicted by schematic representation an integrated hydroisomerization/alkylation process system 10. A gasoline range hydrocarbon stream comprising, consisting of, or consisting essentially of hydrocarbons having at least three carbon atoms per molecule is introduced to first separator 12, which defines a first separation zone, via conduit 14. A hydrocarbon feedstock comprising at least one $C_5$ olefin is removed overhead from first separator 12 via conduit 16 and is introduced to hydroisomerization reactor 18, which defines a hydroisomerization zone. A $C_6$+ gasoline blending stock is removed from first separator 12 via conduit 20. A hydrogen stream is charged to hydroisomerization reactor 18 via conduits 22 and 16. A hydroisomerate stream passes from hydroisomerization reactor 18 to an alkylation unit 24 via conduit 26. A light olefin stream comprising i-propylene, i-butene, 2-butenes, 1-butenes, and combinations of any two or more thereof, is optionally charged to alkylation unit 24 via conduits 28 and 26. An alkylate stream is passed from alkylation unit 24 to a second separator 30, defining a second separation zone, via conduit 32, wherein the alkylate stream is separated into various products. A propane containing stream is removed from second separator 30 via conduit 34 and is sent downstream for further processing. A n-butane stream is removed from second separator 30 via conduit 36.

A $C_5$+ alkylate stream is removed from separator 30 via conduit 38 and can be sent downstream for use as a gasoline blending stock. At least a portion of the $C_5$+ alkylate can also be sent to a third separator 40, defining a third separation zone, via conduits 38 and 42 for separation into an i-pentane stream and a deisopentanized $C_5$+ alkylate stream. The i-pentane stream is removed from third separator 40 via conduit 44 and can be used as a gasoline blending stock, preferably added to the $C_6$+ gasoline blending stock to improve its octane. The deisopentanized $C_5$+ alkylate stream is removed from third separator 40 via conduit 46 and can be used as a gasoline blending stock.

The following examples demonstrate the advantages of the present invention. These examples are for illustration purposes only and they are not intended to limit the invention as set out in the specification and the appended claims.

EXAMPLE I

This example illustrates the benefits of hydroisomerizing a $C_5$ olefin containing hydrocarbon feed prior to alkylation.

The alkylation batch reactor was a monel autoclave of 300 ml capacity connected at one end to a monel sight gauge via ¼" monel tubing, and connected at the other end to a feed introduction line via ⅛" monel tubing.

For each run, the catalyst was circulated through the reactor at a stirring rate of 1500 rpm. The catalyst composition contained 92 wt. % HF, 1–2 wt. % water with the balance comprising acid soluble oil and dissolved light hydrocarbons.

Run 1 (Control)

For Run 1, a feed composition (presented in Table 1) was prepared, by mixing pure components, to be representative of an alkylation unit feed containing an i-butane component and a $C_5$ olefin component. The $C_5$ olefin component was blended to be representative of a raw $C_5$ olefin stream similar to a $C_5$ cut from a catalytic cracker gasoline stream. The feed was alkylated in a batch reactor in which 127.5 grams of HF were stirred at 1500 rpm. The reactor temperature was about 96.5° F. and the volume to volume ratio of HF acid to hydrocarbon was 1:1. The HF and alkylate product were collected in a settler and allowed to separate. The alkylate product was drawn off into a suitable sample cylinder, contacted with 8.5% KOH solution (to destroy free HF), collected, and analyzed by standard gas chromatography using a GC sample injection valve so that no light materials were lost. The separated alkylate product was collected and analyzed at the end of the run (1.5 minutes). Test data results are provided in Table 2.

Run 2 (Control)

For Run 2, a feed composition (presented in Table 1) was prepared, by mixing pure components, to be representative of an alkylation unit feed containing an i-butane component and a $C_5$ olefin component. The $C_5$ olefin component was blended to be representative of a $C_5$ olefin stream produced by sequentially hydroisomerizing and etherifying a raw $C_5$ olefin stream similar to that of Control Run 1. The feed was alkylated in a batch reactor in which 127.0 grams of HF were stirred at 1500 rpm. The reactor temperature was about 95.8° F. and the volume to volume ratio of HF acid to hydrocarbon was 1:1. The HF and alkylate product were collected in a settler and allowed to separate. The alkylate product was drawn off into a suitable sample cylinder, contacted with 8.5% KOH solution at an ambient temperature (to destroy free HF), collected, and analyzed by standard gas chromatography using a GC sample injection valve so that no light materials were lost. The separated alkylate product was collected and analyzed at the end of the run (1.5 minutes). Test data results are provided in Table 2.

Run 3 (Inventive)

For Run 3, a feed composition (presented in Table 1) was prepared, by mixing pure components, to be representative of an alkylation unit feed containing an i-butane component and a $C_5$ olefin component. The $C_5$ olefin component was blended to be representative of a $C_5$ olefin hydroisomerate stream produced by hydroisomerizing a raw $C_5$ olefin stream similar to that of Control Run 1. The feed was alkylated in a batch reactor in which 127.9 grams of HF were stirred at 1500 rpm. The reactor temperature was about 95.1° F. and the volume to volume ratio of HF acid to hydrocarbon was 1:1. The HF and alkylate product were collected in a settler and allowed to separate. The alkylate product was drawn off into a suitable sample cylinder, contacted with 8.5% KOH solution at an ambient temperature (to destroy free HF), collected, and analyzed by standard gas chromatography using a GC sample injection valve so that no light materials were lost. The separated alkylate product was collected and analyzed at the end of the run (1.5 minutes). Test data results are provided in Table 2.

TABLE 1

| Component | Run 1 (Control) | Run 2 (Control) | Run 3 (Inventive) |
|---|---|---|---|
| Paraffins | | | |
| Lights | 0.002 | 0.003 | 0.002 |
| propane | 0.803 | 0.827 | 0.818 |
| i-butane | 89.811 | 89.603 | 90.019 |

TABLE 1-continued

| Component | Run 1 (Control) | Run 2 (Control) | Run 3 (Inventive) |
|---|---|---|---|
| n-butane | 1.978 | 1.967 | 1.967 |
| i-pentane | 0.003 | 0.002 | 0.005 |
| Olefins | | | |
| 1-pentene | 0.656 | 0.512 | 0.269 |
| 2-methyl-butene-1 | 0.199 | 0.027 | 0.216 |
| (t) 2-pentene | 2.029 | 4.332 | 2.048 |
| (c) 2-pentene | 0.931 | 2.042 | 0.965 |
| 2-methyl-butene-2 | 3.090 | 0.369 | 3.306 |
| pentadienes | 0.276 | — | — |
| cyclopentene | 0.083 | 0.263 | 0.221 |
| $C_6$+ | 0.104 | 0.017 | 0.085 |
| unknowns | 0.035 | 0.036 | 0.079 |
| Total | 100 | 100 | 100 |
| I/O ratio[1] | 12.85 | 11.88 | 12.81 |
| isopentene/ n-pentene ratio | 0.909 | 0.057 | 1.073 |

[1]I/O ratio Isoparaffin to Olefin ratio, weight/weight

TABLE 2

| Component | Alkylation Product Run 1 (Control) | Run 2 (Control) | Run 3 (Inventive) |
|---|---|---|---|
| ethane | 0.001 | 0.001 | 0.001 |
| propane | 0.669 | 0.698 | 0.692 |
| i-butane | 81.196 | 80.522 | 80.557 |
| n-butane | 2.052 | 2.021 | 2.035 |
| organic fluorides | 0.066 | 0.067 | 0.072 |
| i-pentane | 4.253 | 3.186 | 4.483 |
| n-pentane | 0.153 | 0.424 | 0.136 |
| $C_6$ pariffins | 0.230 | 0.168 | 0.288 |
| $C_7$ pariffins | 0.186 | 0.130 | 0.193 |
| $C_8$ pariffins | 6.027 | 4.269 | 6.171 |
| $C_9$ pariffins | 2.873 | 5.477 | 3.044 |
| unknown/residue | 2.294 | 3.037 | 2.326 |
| Total | 100 | 100 | 100 |
| $C_5$+ wt. % yield[1] | 2.31 | 2.23 | 2.39 |
| Net $C_{5+}$ Product | | | |
| i-pentane | 26.531 | 19.087 | 26.890 |
| n-pentane | 0.957 | 2.535 | 0.815 |
| $C_6$ pariffins | 1.434 | 1.009 | 1.729 |
| $C_7$ pariffins | 1.160 | 0.782 | 1.159 |
| $C_8$ pariffins | 37.632 | 25.595 | 37.066 |
| $C_9$+ pariffins | 31.879 | 50.780 | 31.942 |
| unknowns | 0.375 | 0.261 | 0.314 |
| Total | 100 | 100 | 100 |
| RON[2] | 91.8 | 89.8 | 91.9 |
| MON[3] | 90.6 | 89.0 | 90.6 |
| (R + M)/2[4] | 91.2 | 89.4 | 91.3 |

[1]$C_5$+ wt. % yield is equal to the wt. % $C_5$+ in the product divided by the wt. % olefins in the feed.
[2]Estimated by Gas Chromatograph according to the Hutson and Logan method, Hydrocarbon Processing, Sept. 1975, pages 107–110.
[3]Estimated by Gas Chromatograph according to the Hutson and Logan method, Hydrocarbon Processing, Sept. 1975, pages 107–110.
[4]Numerical average of collected RON and MON The test results presented in Table 2 show that the inventive process (Run 3) of hydroisomerizing a hydrocarbon feed containing $C_5$ olefins followed by alkylating the resulting intermediate product results in a product having a higher octane rating and increased $C_5$+ wt. % yield per wt. of $C_5$ olefin in the feed as compared to Control Run 1 which includes only the alkylation of the hydrocarbon feed, and, as compared to Control Run 2 which includes hydroisomerization of the hydrocarbon feed followed by etherification to convert isopentenes (such as 2-methyl-butene-2) to oxygenates (such as methyl-tertiary-butyl ether), which are then removed, and alkylation of the remaining intermediate product.

Inventive Run 3 demonstrated a 0.1% increase in octane (R+M/2) and a 3.5% increase in $C_5$+ wt. % yield per wt. of $C_5$ olefin in the feed over Control Run 1.

Inventive Run 3 demonstrated a 2.1% increase in octane (R+M/2) and a 7.2% increase in $C_5$+ wt. % yield per wt. of $C_5$ olefin in the feed over Control Run 2.

EXAMPLE II

This example illustrates the benefits of hydroisomerizing a $C_5$ olefin containing hydrocarbon feed prior to alkylation.

The reactor was a section of monel schedule 40 pipe 2 feet in length and 1 inch in diameter connected at one end to a monel sight gauge via ¼" monel tubing, and connected at the other end to a feed introduction nozzle, having a 0.01 inch diameter orifice, via ⅛" monel tubing.

For each run, the catalyst was circulated through the reactor and monel sight gauge at a flow rate in the range of from about 50 ml/min to about 100 ml/min. The catalyst composition contained approximately 87–88 wt. % HF, 1–2 wt. % water with the balance comprising acid soluble oil and dissolved light hydrocarbons.

Control Run 4

The composition of the hydrocarbon feed for Control Run 4 is presented in Table 3, and is a mixture of three components, 1) a $C_5$ olefin fraction from a full range FCC gasoline; 2) a typical propylene and butylene alkylation unit feed and; 3) a typical isobutane alkylation unit feed. The hydrocarbon feed was pumped through the feed introduction nozzle into the reactor at a rate of about 300 ml/hour. The reactor effluent flowed into the monel sight gauge wherein the hydrocarbon product and any catalyst carryover were separated.

The hydrocarbon product was drawn off into a suitable sample cylinder, passed over alumina at an ambient temperature (to adsorb free HF), collected, and analyzed by standard gas chromatography using a GC sample injection valve so that no light materials were lost. Test data results for Control Run 4 are summarized in Table 4.

Inventive Run 5

The composition of the hydrocarbon feed for Inventive Run 5 is presented in Table 3, and is a mixture of three components, 1) a typical propylene and butylene alkylation unit feed; 2) a typical isobutane alkylation unit feed, and; 3) a $C_5$ olefin fraction from a full range FCC gasoline which had first been hydroisomerized over a palladium on alumina catalyst at 104–127° F., at a LHSV of 6 hr.$^{-1}$, and at a $H_2$/diolefin mole ratio of 4.3.

The hydrocarbon feed was pumped through the feed introduction nozzle into the reactor at a rate of about 300 ml/hr. The reactor effluent flowed into the monel sight gauge wherein the hydrocarbon product and any catalyst carryover were separated.

The hydrocarbon product was drawn off into a suitable sample cylinder, passed over alumina at an ambient temperature (to adsorb free HF), collected, and analyzed by standard gas chromatography using a GC sample injection valve so that no light materials were lost. Test data results for Inventive Run 5 are summarized in Table 4.

TABLE 3

| | Hydrocarbon Feeds | |
|---|---|---|
| Component | Run 4 (Control) | Run 5 (Inventive) |
| i-butane | 87.17 | 86.69 |
| olefins | 7.64 | 7.80 |
| % $C_3$ = in olefins | 23.7 | 23.3 |
| % $C_4$ = in olefins | 53.4 | 53.9 |
| % $C_5$ = in olefins | 22.9 | 22.6 |
| $C_5$ dienes[1] (ppmw) | 386 | 21 |
| I/O ratio[2] | 11.4 | 11.1 |

[1]isoprene and piperylene
[2]Isoparaffin to Olefin ratio, weight/weight

TABLE 4

| | Alkylate Product Net Basis | |
|---|---|---|
| Component | Run 4 (Control) | Run 5 (Inventive) |
| i $C_5$ paraffin (wt. %) | 10.3 | 9.62 |
| $C_6$ paraffin (wt. %) | 2.94 | 2.34 |
| $C_7$ paraffin (wt. %) | 12.3 | 11.8 |
| $C_8$ paraffin (wt. %) | 44.4 | 48.9 |
| $C_9$+ paraffin (wt. %) | 15.3 | 13.2 |
| RON[1] | 91.8 | 92.9 |
| MON[2] | 91.3 | 91.9 |
| (R + M)/2[3] | 91.6 | 92.4 |
| $C_5$+ Yield (vol $C_5$+/vol olefin in feed) | 1.89 | 1.90 |
| ASO Rate (lbs ASO/bbl $C_5$+ product) | 0.8 | 0.3 |
| T50 (° F.)[4] | 226 | 223 |
| T90 (° F.)[4] | 297 | 269 |
| Endpoint (° F.)[4] | 422 | 395 |
| Reactor Temp., ° F. | 94.6 | 96.4 |

[1]Determined using ASTM Engine Test D-2699-97 ae 1
[2]Determined using ASTM Engine Test D-2700-97 e 1
[3]Average of RON and MON
[4]Determined using ASTM test method D-86-99 ae 1
T-50—boiling point at which 50 volume % of the sample has boiled overhead
T-90—boiling point at which 90 volume % of the sample has boiled overhead
endpoint—boiling point at which 100 volume % of the sample has boiled overhead The test data results in Table 4 demonstrate the following advantages of first hydroisomerizing a $C_5$ olefin containing hydrocarbon feed prior to alkylation as compared to a process not including such hydroisomerization: 1) increased octane rating ((R+M)/2); 2) increased $C_5$+ yield; 3) decreased ASO production rate; 4) decreased $C_9$+ paraffin concentration in product; and 5) lower T50, T90 and endpoint boiling points.

Inventive Run 5 demonstrated a 0.9% increase in octane rating, a 0.5% increase in $C_5$+ yield, a 62.5% decrease in ASO production rate (lbs ASO/bbl $C_5$+ in product), and a 13.7% decrease in $C_9$+ paraffin wt. % as compared to Control Run 4.

Inventive Run 5 also, unexpectedly, demonstrated a 1.3% decrease in the T50 boiling point, a 9.4% decrease in the T90 boiling point, and a 6.4% decrease in the endpoint boiling point for the product as compared to Control Run 4. This decreased endpoint, in particular, results in a much higher quality gasoline blend stock as compared to Control Run 4.

Also, the data show that, unexpectedly, $C_5$ dienes have a large impact on heavy alkylate production. Reducing the $C_5$ dienes from 386 ppmw in Control Run 4 to 21 ppmw in Inventive Run 5 contributes to the decrease in C9+ production, and this, in turn, leads to lower i-pentane production and lower T90, and endpoint values. The i-pentane production is cut by 6.6%, which will lead to lower RVP of the $C_5$+ product.

EXAMPLE III

This example illustrates the benefits of hydroisomerizing a $C_5$ olefin containing hydrocarbon feed prior to alkylation.

The reactor was a section of monel schedule 40 pipe 2 feet in length and 1 inch in diameter connected at one end to a monel sight gauge via ¼" monel tubing, and connected at the other end to a feed introduction nozzle, having a 0.01 inch diameter orifice, via ⅛" monel tubing.

For each run, the catalyst was circulated through the reactor and monel sight gauge at a flow rate in the range of from about 50 ml/min to about 100 ml/min. The catalyst composition contained approximately 87–88 wt. % HF, 1–2 wt. % water with the balance comprising acid soluble oil and dissolved light hydrocarbons.

Control Run 6

The composition of the hydrocarbon feed for Control Run 6 is presented in Table 5, and is a mixture of two components, 1) a typical mixed olefin alkylation unit feed and; 2) a typical isobutane alkylation unit feed. The hydrocarbon feed was pumped through the feed introduction nozzle into the reactor at a rate of about 300 ml/hour. The reactor effluent flowed into the monel sight gauge wherein the hydrocarbon product and any catalyst carryover were separated.

The hydrocarbon product was drawn off into a suitable sample cylinder, passed over alumina at an ambient temperature (to adsorb free HF), collected, and analyzed by standard gas chromatography using a GC sample injection valve so that no light materials were lost. Test data results for Control Run 6 are summarized in Table 6.

Control Run 7

The composition of the hydrocarbon feed for Control Run 7 is presented in Table 5, and is a mixture of three components, 1) a $C_5$ olefin fraction from a full range FCC gasoline; 2) a typical mixed olefin alkylation unit feed and; 3) a typical isobutane alkylation unit feed. The hydrocarbon feed was pumped through the feed introduction nozzle into the reactor at a rate of about 300 ml/hour. The reactor effluent flowed into the monel sight gauge wherein the hydrocarbon product and any catalyst carryover were separated.

The hydrocarbon product was drawn off into a suitable sample cylinder, passed over alumina at an ambient temperature (to adsorb free HF), collected, and analyzed by standard gas chromatography using a GC sample injection valve so that no light materials were lost. Test data results for Control Run 7 are summarized in Table 6.

Inventive Run 8

The composition of the hydrocarbon feed for Inventive Run 8 is presented in Table 5, and is a mixture of three components, 1) a typical mixed olefin alkylation unit feed; 2) a typical isobutane alkylation unit feed, and; 3) a $C_5$ olefin fraction from a full range FCC gasoline which had first been hydroisomerized over a palladium on alumina catalyst at 183–193° F., at a LHSV of 10 $hr.^{-1}$, and at a $H_2$/diolefin mole ratio of 4.0.

The hydrocarbon feed was pumped through the feed introduction nozzle into the reactor at a rate of about 300 ml/hr. The reactor effluent flowed into the monel sight gauge wherein the hydrocarbon product and any catalyst carryover were separated.

The hydrocarbon product was drawn off into a suitable sample cylinder, passed over alumina at an ambient temperature (to adsorb free HF), collected, and analyzed by standard gas chromatography using a GC sample injection valve so that no light materials were lost. Test data results for Inventive Run 8 are summarized in Table 6.

TABLE 5

| Hydrocarbon Feeds | | | |
|---|---|---|---|
| Component | Run 6 (Control) | Run 7 (Control) | Run 8 (Inventive) |
| Paraffins | | | |
| propane | 1.213 | 0.807 | 0.876 |
| i-butane | 85.708 | 85.595 | 84.855 |
| n-butane | 3.150 | 2.830 | 3.325 |
| i-pentane | 1.059 | 1.328 | 1.139 |
| n-pentane | 0.072 | 0.313 | 0.438 |
| cyclopentane | 0.000 | 0.095 | 0.139 |
| Olefins | | | |
| propylene | 3.124 | 2.078 | 2.257 |
| butylenes | 4.849 | 3.887 | 4.277 |
| 2-methyl-butene-2 | 0.181 | 1.031 | 1.064 |
| 2-methyl-butene-1 | 0.220 | 0.474 | 0.268 |
| 3-methyl-butene-1 | 0.089 | 0.068 | 0.063 |
| 1-pentene | 0.105 | 0.247 | 0.101 |
| 2-pentene | 0.230 | 1.004 | 0.918 |
| Dienes | | | |
| iso + n-pentadienes | 0.000 | 0.093 | 0.000 |
| cyclopentene | 0.000 | 0.158 | 0.090 |
| Olefin Only Basis | | | |
| propylene | 35.51 | 23.64 | 25.22 |
| butylene | 55.11 | 44.23 | 47.80 |
| i-pentenes | 5.58 | 17.90 | 15.59 |
| 1-pentene | 1.19 | 2.81 | 1.13 |
| 2-pentene | 2.61 | 11.42 | 10.26 |
| i-pentene/ n-pentene Ratio (w/w) | 1.47 | 1.26 | 1.37 |
| I/O Ratio (w/w)[1] | 9.74 | 9.74 | 9.48 |
| i-pentane/ olefin Ratio (w/w) | 0.120 | 0.149 | 0.122 |

[1]I/O Ratio = Isoparaffin to Olefin ratio, weight/weight

TABLE 6

| Alkylate Product Net Basis | | | |
|---|---|---|---|
| Component | Run 6 (Control) | Run 7 (Control) | Run 8 (Inventive) |
| i-pentane | 6.91 | 14.16 | 9.61 |
| n-pentane | 0.17 | 0.21 | 0.27 |
| $C_6$ pariffins | 3.42 | 6.07 | 3.67 |
| $C_7$ pariffins | 20.50 | 12.76 | 14.31 |
| $C_8$ pariffins | 58.07 | 37.64 | 58.46 |
| $C_9$+ pariffins | 10.84 | 29.07 | 13.54 |
| unknowns | 0.099 | 0.093 | 0.131 |
| trimethylpentane (TMP) | 48.59 | 28.53 | 48.83 |
| dimethylhexane (DMH) | 9.48 | 9.06 | 9.62 |
| TMP/DMH | 5.13 | 3.15 | 5.07 |
| ReactorTemp., ° F. | 105 | 98.2 | 102 |
| RON[1] | 92.4 | 88.5 | 93.1 |
| MON[2] | 92.0 | 88.4 | 92.0 |
| (R + M)/2 | 92.2 | 88.5 | 92.6 |
| EP (° F.)[3] | 388 | 441 | 396 |
| C5+ Yield (vol C5+/vol olefin in feed)[3] | 1.80 | 1.88 | 1.90 |
| ASO Rate (lb/bbl C5+) | 0.2 | 3.2 | 0.4 |

[1]Determined using ASTM engine test D-2699-97 ae 1
[2]RON and MON determined using ASTM engine test D-2700-97 e1 (R + M)/2 = average of RON and MON
[3]Estimated by Gas Chromatograph according to the Hutson and Logan method, Hydrocarbon Processing, September 1975, pages 107–110

The test data results in Table 6 demonstrate the following advantages of first hydroisomerizing a $C_5$ olefin containing hydrocarbon feed prior to alkylation as compared to a process not including such hydroisomerization: 1) increased octane rating ((R+M)/2); 2) increased $C_5$+ yield; 3) decreased ASO production rate; 4) decreased $C_9$+ paraffin concentration in product; 5) lower endpoint boiling point; 6) reduced net i-pentane; 7) increased $C_8$ paraffin yield; and an increase in trimethylpentane production.

Inventive Run 8 demonstrated a 4.6% increase in octane rating, a 1.1% increase in $C_5$+ yield, an 88% decrease in ASO production rate (lbs ASO/bbl $C_5$+ in product), a 53% decrease in $C_9$+ paraffin wt. %, a 32% reduction in net i-pentane production, a 55% increase in $C_8$ paraffin yield, and a 71% increase in trimethylpentane production, as compared to Control Run 7.

Inventive Run 8 also, unexpectedly, demonstrated a 10.2% decrease in the endpoint boiling point for the product as compared to Control Run 7. This decreased endpoint, in particular, results in a much higher quality gasoline blend stock as compared to Control Run 7.

In addition, the lower I/O Ratio for Inventive Run 8 (9.48) as compared to the I/O Ratio for Control Run 7 (9.74) would lead one skilled in the art to expect a lower alkylate quality for Inventive Run 8 as compared to Control Run 7. However, as demonstrated above, the alkylate quality for Inventive Run 8 is significantly better than the alkylate quality for Control Run 7.

Reasonable variations, modifications, and adaptations can be made within the scope of the disclosure and the appended claims without departing from the scope of this invention.

That which is claimed is:

1. A method for processing a hydrocarbon feedstock comprising at least one $C_5$ olefin comprising the steps of:

a) hydroisomerizing said hydrocarbon feedstock in a hydroisomerization zone so as to produce a hydroisomerate stream, wherein said hydroisomerate stream does not pass through an etherification zone; and b) alkylating at least a portion of said hydroisomerate stream by a branched chain paraffin hydrocarbon in an alkylation unit to produce an alkylate stream.

2. A method in accordance with claim 1 wherein said at least one $C_5$ olefin of said hydrocarbon feedstock comprises an olefin selected from the group consisting of 2-pentene, 2 methyl-butene-2,1-pentene, 3-methyl-butene-1,2-methyl-butene-1, isoprene, piperylene, cyclopentene, and combinations of any two or more thereof.

3. A method in accordance with claim 1 wherein said hydrocarbon feedstock comprises cyclopentene; and wherein said hydroisomerizing of step a) comprises conversion of a portion of said cyclopentene to cyclopentane.

4. A method in accordance with claim 1 wherein said hydroisomerization zone includes the presence of hydrogen, a hydroisomerization catalyst and is operated at a temperature in the range of from about 0° F. to about 500° F., a pressure in the range of from about 100 psig to about 1500 psig, and a LHSV in the range of from about 0.01 $hr.^{-1}$ to about 100 $hr.^{-1}$.

5. A method in accordance with claim 4 wherein the hydrogen to diolefin mole ratio in said hydroisomerization zone is in the range of from about 0.5 to about 50.

6. A method in accordance with claim 4 wherein said hydroisomerization catalyst comprises palladium and alumina.

7. A method in accordance with claim 1 wherein said branched chain paraffin hydrocarbon comprises a hydrocarbon selected from the group consisting of i-butane, i-pentane, and combinations thereof.

8. A method in accordance with claim 1 wherein said alkylate stream is separated into a $C_5$+ alkylate stream, a n-butane stream and an i-butane stream; and wherein said $C_5$+ alkylate stream is utilized as a gasoline blending stock.

9. A method in accordance with claim 8 wherein said i-butane stream is recycled to said alkylation unit for use as said branched chain paraffin hydrocarbon.

10. A method in accordance with claim 1 wherein said alkylate stream is separated thereby forming a $C_5$+ alkylate stream;

said $C_5$+ alkylate stream is separated into an i-pentane stream and a deisopentanized $C_5$+ alkylate stream;

i-pentane stream is utilized as a first gasoline blending stock; and said deisopentanized $C_5$+ alkylate stream is utilized as a second gasoline blending stock.

11. A method in accordance with claim 1 wherein, prior to step a), a gasoline range hydrocarbon stream comprising hydrocarbons having at least three carbon atoms per molecule is separated into a $C_6$+ gasoline blending stock and into said hydrocarbon feedstock comprising at least one $C_5$ olefin.

12. A method in accordance with claim 1 wherein a light olefin stream comprising an olefin selected from the group consisting of propylene, i-butene, 2-butenes, 1-butenes, and combinations of any two or more thereof is combined with and becomes a part of said hydroisomerate stream prior to step b).

* * * * *

UNITED STATES PATENT AND TRADEMARK OFFICE

CERTIFICATE OF CORRECTION

PATENT NO. : 6,395,945 B1
DATED : May 31, 2000
INVENTOR(S) : Bruce B. Randolph

It is certified that error appears in the above-identified patent and that said Letters Patent is hereby corrected as shown below:

Column 12,
Line 32, please insert -- said -- in front of pentane.

Signed and Sealed this

Twenty-ninth Day of April, 2003

JAMES E. ROGAN
*Director of the United States Patent and Trademark Office*